United States Patent [19]

Röck et al.

[11] Patent Number: 4,604,769

[45] Date of Patent: Aug. 12, 1986

[54] HINGE

[75] Inventors: Erich Röck, Höchst; Klaüs Brüstle; Helmut Rupprechter, both of Lauterach, all of Austria

[73] Assignee: Julius Blum Gesellschaft m.b.H., Höchst, Austria

[21] Appl. No.: 552,909

[22] Filed: Nov. 17, 1983

[30] Foreign Application Priority Data

Dec. 6, 1982 [AT] Austria ..... 4423/82

[51] Int. Cl.[4] ..... E05D 7/04

[52] U.S. Cl. ..... 16/238; 16/245

[58] Field of Search ..... 16/238, 245, 240, 241, 16/374, 235, 246

[56] References Cited

U.S. PATENT DOCUMENTS

| | | | |
|---|---|---|---|
| 3,965,530 | 6/1976 | Rock et al. | 16/246 |
| 4,045,841 | 9/1977 | Rock et al. | 16/129 |
| 4,209,946 | 7/1980 | Akai | 16/245 |
| 4,359,802 | 11/1982 | Rock | 16/238 |
| 4,400,848 | 8/1983 | Grass | 16/374 |

FOREIGN PATENT DOCUMENTS

| | | | |
|---|---|---|---|
| 341908 | 3/1978 | Austria | 16/DIG. 43 |
| 1945010 | 7/1977 | Fed. Rep. of Germany | 16/370 |

*Primary Examiner*—Donald R. Schran
*Assistant Examiner*—James L. Wolfe
*Attorney, Agent, or Firm*—Wenderoth, Lind & Ponack

[57] ABSTRACT

A hinge which is to be secured to the frame of a piece of furniture includes a mounting body and an intermediate member and a hinge arm adjustably connected to the mounting body. An adjusting screw is mounted in the intermediate member, is aligned perpendicularly to a hinge axle of the hinge and extends in a plane which is parallel to the closing plane of the door of the piece of furniture. The adjusting screw has a bolt portion of reduced diameter defining a recess into which extends a projection of the mounting body.

6 Claims, 5 Drawing Figures

HINGE

BACKGROUND OF THE INVENTION

1. Field of the Invention

The invention relates to an adjustable hinge for connecting a door with a furniture frame. The hinge includes a hinge casing fittable into an opening in the door and a mounting body mountable on the frame and carrying a hinge arm by means of an intermediate member, the hinge casing being pivotally mounted at the hinge arm by means of hinge axles or hinge links, and the hinge arm being held on the intermediate member by means of a clamping screw.

2. Description of the Prior Art

Such hinges are widely used in modern furniture construction. The advantage of mounting the door on a frame is that the actual furniture side walls can be of thinner material, thus reducing costs on the one hand and permitting the use of more expensive materials which are preferred because of their surfaces and aesthetic appearance on the other hand.

In the same manner as in the case of hinges which are directly secured to the furniture side wall, it is desirable to be able to adjust the hinge in one or several manners.

SUMMARY OF THE INVENTION

It is the object of the invention to provide a hinge of the afore-mentioned kind by means of which a precise adjustment of the hinge in the direction of the joint gap is obtained in a simple manner.

According to the invention this is achieved in that an adjusting screw is mounted in a female thread of the intermediate member. The adjusting screw is aligned perpendicularly to the hinge axle or axles, extends in a plane parallel to the closing plane of the door and has a bolt portion of reduced diameter forming an annular groove into which extends at least one radially aligned projection of the mounting body.

It is preferably provided that the projections are formed by two flaps which are arranged opposite each other and which extend with respect to the mounting body at an angle of between 0° and 90° , preferably between 25° and 40°.

An embodiment of the invention provides that the intermediate member has a nose or projection which is directed towards the mounting body and whose displacement path is limited by a stop or stops on the mounting body.

BRIEF DESCRIPTION OF THE DRAWINGS

Two embodiments of the invention will be described in more detail with reference to the accompanying drawings, in which.

DESCRIPTION OF THE PREFERRED EMBODIMENTS

Figure 5:
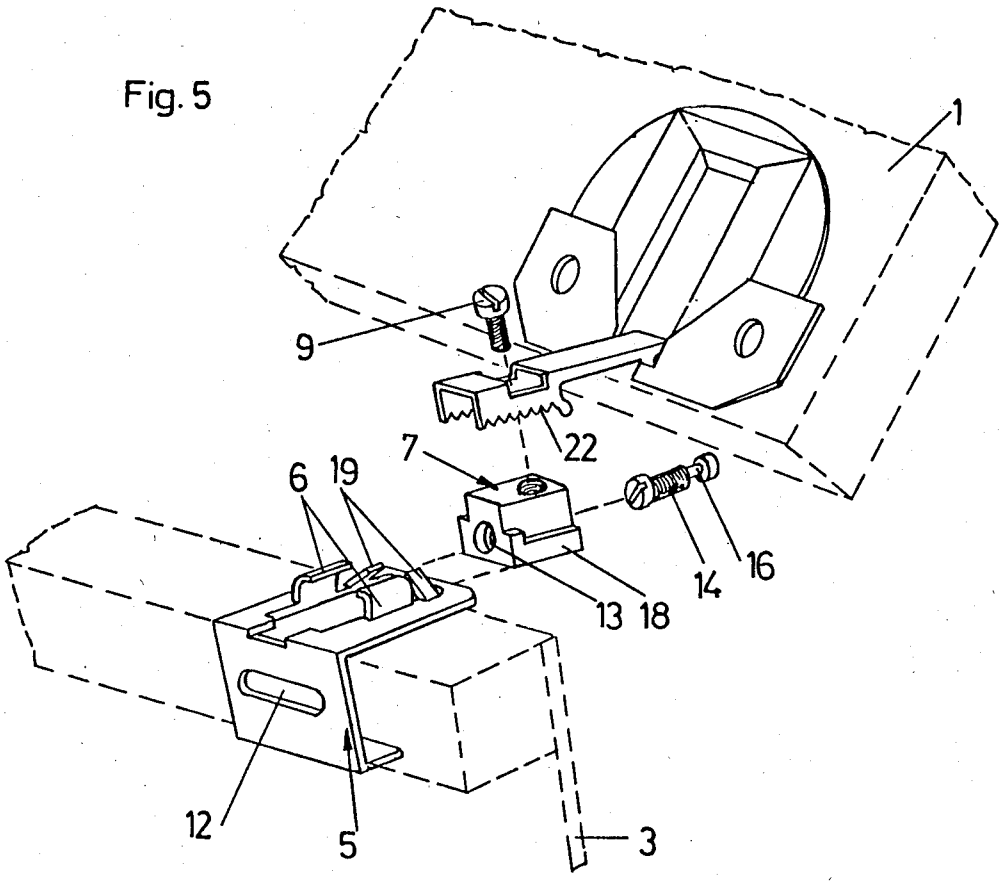
FIG. 5 is a diagrammatic perspective view, the parts being shown apart, of the embodiment according to FIGS. 1 to 3.

In the drawings, reference number 1 designates a door, 2 a door frame and 3 a furniture side wall. A hinge casing 4 is fitted into the door 1. A mounting body 5 is secured to the frame 2 by means of a screw which projects through a slot 12. The mounting body 5 embraces the frame 2 in a A-shaped manner (see FIG. 5). The mounting body 5 in the illustrated embodiment has two guide flanges 6 below and between which is inserted an intermediate member 7.

The intermediate member 7 carries a hinge arm 8 which is secured to the intermediate member 7 by means of a clamping screw 9.

The clamping screw 9 projects through a hole 10 in the hinge arm 8 and is held in a female thread 11 of the intermediate member 7. The intermediate member 7 has marginal flanges 18. When the clamping screw 9 is tightened, the marginal flanges 18 of the intermediate member 7 and side flanges 8' of the hinge arm 8 clamp therebetween the guide flanges 6 (in directions perpendicular to the mounting plane of the mounting body 5).

An adjusting screw 14 which is aligned perpendicularly or orthogonally to a hinge axle 15 and parallel to the closing plane of the door 1, is mounted in a female thread 13 in the intermediate member 7. The screw 14 has a reduced diameter bolt portion 16. A projection 17 of the mounting body 5 (FIG. 4) or projections 19 which are formed by oblique flaps extending from a planar portion of the mounting body 5 (FIGS. 1 to 3 and 5) engage into an annular groove which is formed by bolt portion 16. By turning the adjusting screw 14, the member 7 and hinge arm 8 are adjusted in the directions of double arrow A.

Figure 4:
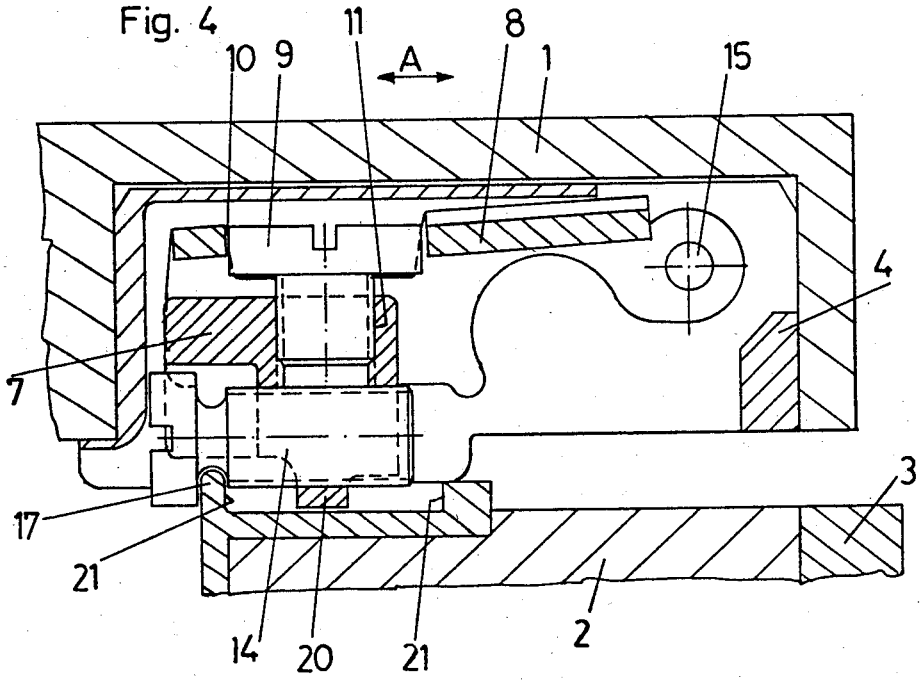
FIG. 4 is a horizontal sectional view analogous to FIG. 2 of is second embodiment of the invention.

To make the hinge arm 8 adjustable by means of the adjusting screw 14, the clamping screw 9 must be loosened. In order to prevent the intermediate member 7 from being moved too far, member 7 may be provided with a nose or projection 20 whose path of displacement is limited by stops 21 provided on the mounting body 5 (FIG. 4).

To improve the fit of the hinge arm 8, lateral flanges 8' may be provided with indentations 22.

After adjustment of the joint by means of screw 14 the clamping screw 9 is tightened, and thereby the hinge is fixed with respect to its position on the frame.

Figure 1:
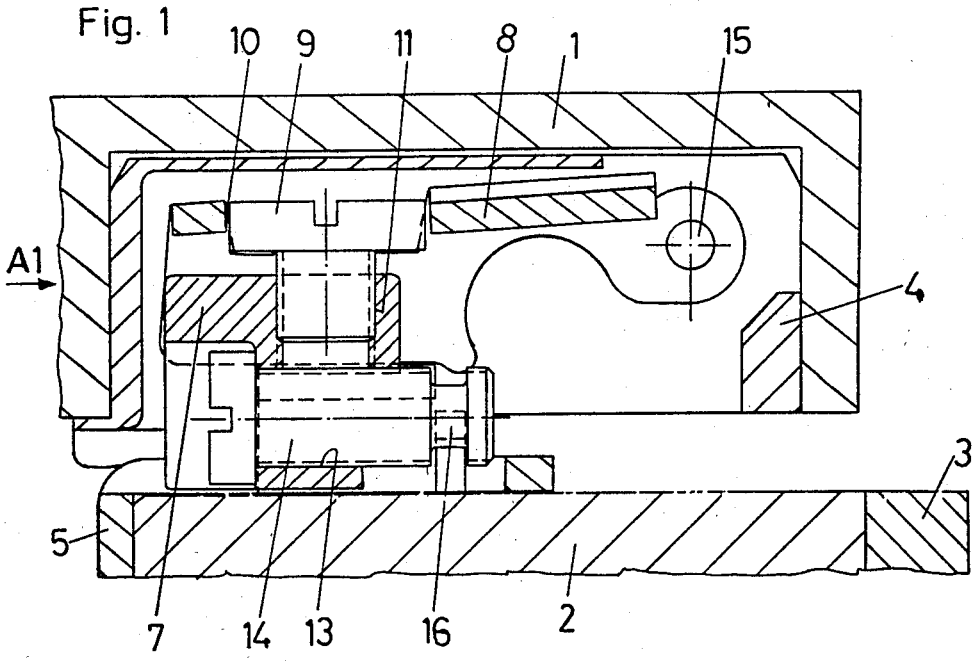
FIGS. 1 and 2 are horizontal sectional views of a hinge according to the invention.
Figure 2:
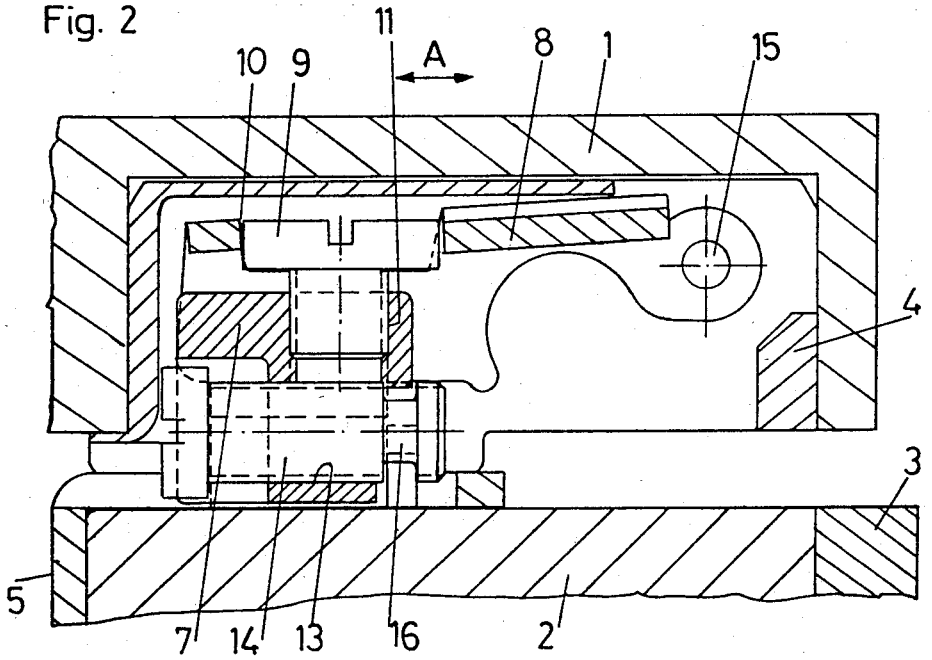
Figure 3:
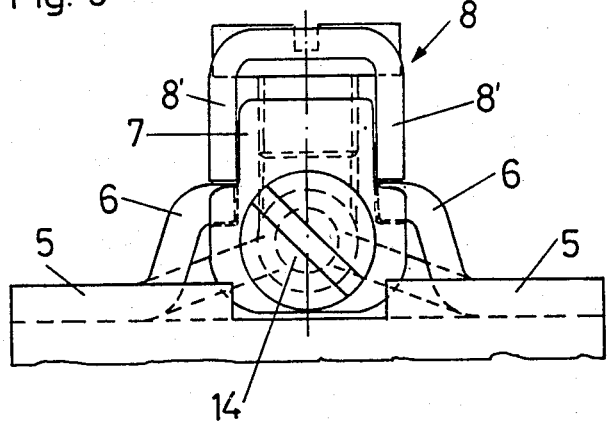
FIG. 3 is an end view from the direction of arrow A1 of FIG. 1.

FIGS. 1 and 2 show the two extreme positions of the intermediate member 7 in the direction of the joint width.

What is claimed is:

1. An adjustable hinge for mounting a door of an article of furniture to a frame thereof such that the door is movable between an open position away from the frame and a closed position adjacent the frame and extending in a closing plane, said hinge comprising:

a hinge casing adapted to be mounted in a recess in the door;

a mounting body adapted to be mounted on the frame and including a portion extending in a plane parallel to the closing plane, said portion having extending therefrom a pair of guide flanges extending in directions parallel to the closing plane;

a hinge arm pivotally connected to said hinge casing by means of at least one hinge axle, said hinge arm extending longitudinally in a direction parallel to the closing plane, said hinge arm having side flanges extending in directions parallel to said closing plane;

an intermediate member separate from said hinge arm and mounted on said portion of said mounting body for longitudinal sliding movement with respect thereto in opposite directions parallel to the closing plane, said intermediate member having marginal flanges extending in directions parallel to said closing plane;

clamping means, in the form of a single screw, for clamping side guide flanges between said marginal flanges and said side flanges and thereby clamping said hinge arm to said intermediate member and simultaneously for clamping said intermediate member to said portion of said mounting body, said intermediate member, upon loosening of said single screw, being capable of slidable movement in said opposite directions with respect to said portion of said mounting body; and adjusting means for, upon loosening of said single screw, selectively slidably moving said intermediate member and thereby said hinge arm in said opposite directions, said adjusting means comprising an adjusting screw threaded into said intermediate member, said adjusting screw extending orthogonally to said hinge axle and parallel to the closing plane, said adjusting screw having a reduced portion defining an annular groove, and at least one projection extending from said portion of said mounting body into said groove, whereby upon rotation of said adjusting screw said projection prevents axial movement thereof and thus compels said intermediate member to slide in one of said opposite directions with respect to said portion of said mounting body.

2. A hinge as claimed in claim 1, wherein said single screw extends substantially perpendicularly to said adjusting screw.

3. A hinge as claimed in claim 1, wherein, when said single screw is loosened and said adjusting screw is rotated, said guide flanges guide movement of said intermediate member and said hinge arm in one of said opposite directions.

4. A hinge as claimed in claim 1, wherein said at least one projection comprises a pair of projections extending from locations at said portion of said mounting body at opposite sides of said adjusting screw into said annular groove.

5. A hinge as claimed in claim 4, wherein each said projection is inclined to said portion of said mounting body at an angle of from 25° to 40°.

6. A hinge as claimed in claim 1, further comprising means for limiting the extent of movement in said opposite directions of said intermediate member with respect to said mounting body, said limiting means comprising stops on said mounting body and a projection extending from said intermediate member at a position to abut said stops.

* * * * *